US011597106B2

(12) United States Patent
Kerstetter et al.

(10) Patent No.: US 11,597,106 B2
(45) Date of Patent: Mar. 7, 2023

(54) TERMINAL CUTTER FOR REMOVING TERMINALS FROM A CARRIER STRIP

(71) Applicant: TE CONNECTIVITY CORPORATION, Berwyn, PA (US)

(72) Inventors: Chadwick Alan Kerstetter, Richfield, PA (US); Richard Lloyd Schaeffer, Carlisle, PA (US); Caleb Andrew Moyer, Harrisburg, PA (US)

(73) Assignee: TE Connectivity Solutions GmbH

( * ) Notice: Subject to any disclaimer, the term of this patent is extended or adjusted under 35 U.S.C. 154(b) by 148 days.

(21) Appl. No.: 15/655,314

(22) Filed: Jul. 20, 2017

(65) Prior Publication Data

US 2019/0027884 A1 Jan. 24, 2019

(51) Int. Cl.

| | |
|---|---|
| ***B26B 13/22*** | (2006.01) |
| ***H01R 43/04*** | (2006.01) |
| ***B26B 13/00*** | (2006.01) |
| ***H01R 43/042*** | (2006.01) |
| ***H01R 43/045*** | (2006.01) |
| ***H01R 43/055*** | (2006.01) |

(52) U.S. Cl.

CPC ..... *B26B 13/22* (2013.01); *B26B 13/00* (2013.01); *H01R 43/04* (2013.01); *H01R 43/045* (2013.01); *H01R 43/0421* (2013.01); *H01R 43/055* (2013.01)

(58) Field of Classification Search

CPC ..... H01R 43/0421; H01R 43/045; H01R 43/055; B26B 13/00; B26B 13/06; B26B 13/22; B26B 13/24; B26B 17/00; B26B 17/006; B23D 29/02; B23D 33/00

USPC ..... 30/179, 233, 235, 248

See application file for complete search history.

(56) References Cited

U.S. PATENT DOCUMENTS

| | | | | |
|---|---|---|---|---|
| 359,684 A * | 3/1887 | Morrison | B26B 13/06 | 30/254 |
| 384,710 A * | 6/1888 | Peters | B26D 7/015 | 30/119 |
| 1,042,240 A * | 10/1912 | Lillick | A01D 46/28 | 56/331 |

(Continued)

FOREIGN PATENT DOCUMENTS

EP 3431232 A1 * 1/2019 ..... B23D 29/02

OTHER PUBLICATIONS

European Search Report, European Application No. EP18183963.0-1201, International Filing Date Nov. 28, 2018.

(Continued)

*Primary Examiner* — Jason Daniel Prone

(57) ABSTRACT

A terminal cutter includes a tool frame having a first cutting member coupled to an upper handle having a first cutting surface for cutting a terminal from a carrier strip and a second cutting member coupled to a lower handle having a second cutting surface for cutting the terminal from the carrier strip. A terminal strip guide assembly is coupled to the upper handle and/or the lower handle offset from the first and second cutting members. The terminal strip guide assembly includes a strip guide having a slot receiving the carrier strip and having a guide surface adjacent the slot. The guide surface is configured to engage the terminal to locate the terminal relative to the terminal strip guide assembly and to control a depth of the carrier strip received in the slot.

20 Claims, 6 Drawing Sheets

(56) References Cited

U.S. PATENT DOCUMENTS 1,082,385 A * 12/1913 Zimmerman ..... B26B 29/04 144/146
1,263,492 A * 4/1918 Washburn ..... B23D 29/023 30/131
2,587,586 A * 3/1952 Bernardi ..... A01G 3/065 30/248
2,812,676 A 11/1957 Brown
3,010,206 A * 11/1961 Curry ..... B23D 29/023 30/131
3,710,610 A 1/1973 McCaughey
4,106,195 A * 8/1978 Berg ..... B26B 17/00 30/233
4,172,320 A * 10/1979 Welborn ..... B26B 13/00 30/134
4,335,497 A 6/1982 Casey
4,776,096 A * 10/1988 Chang ..... B26B 13/22 30/233
4,876,795 A * 10/1989 Chun-Cheng ..... B26B 13/06 30/233
4,980,962 A 1/1991 Wiebe
5,153,997 A * 10/1992 Chiavaras et al. ..... B26B 13/20 30/235
5,235,750 A * 8/1993 Brown ..... B26B 13/00 30/135
5,870,925 A * 2/1999 Morris ..... H01R 43/042 81/313
6,249,976 B1 * 6/2001 Osame ..... B26B 13/04 30/199
6,513,247 B1 * 2/2003 Krasik-Geiger ..... B26B 13/22 30/233
7,581,320 B2 * 9/2009 Achiwa et al. ..... B26B 13/22 30/131
8,251,759 B2 8/2012 Matsunaga
9,209,586 B2 12/2015 Morris et al.
11,296,472 B2 * 4/2022 Kerstetter ..... H01R 43/0421
2004/0148782 A1 * 8/2004 Lai ..... B26B 13/22 30/233
2005/0274025 A1 * 12/2005 Lin ..... B26B 13/22 30/177
2006/0137192 A1 * 6/2006 Deter ..... B23D 29/026 30/248
2010/0199828 A1 8/2010 Adkins
2011/0235312 A1 * 9/2011 Houser ..... H01R 43/0421 362/119
2013/0014392 A1 * 1/2013 Lin ..... B26B 17/00 30/179
2014/0090527 A1 * 4/2014 Behlen et al. ..... B26B 13/00 83/13
2021/0402456 A1 * 12/2021 Stull ..... H01R 43/045
2022/0200222 A1 * 6/2022 Kerstetter ..... H01R 43/0421

OTHER PUBLICATIONS

Chinese Search Report from First Office Action, Chinese Application No. 2018107949576 dated Jul. 19, 2019.

* cited by examiner

TERMINAL CUTTER FOR REMOVING TERMINALS FROM A CARRIER STRIP

BACKGROUND OF THE INVENTION

The subject matter herein relates generally to terminal cutters for removing terminals from a carrier strip.

Terminals used in electrical connectors are typically stamped and formed from a metal sheet. During the manufacturing process, the terminals are initially held on a carrier strip stamped from the metal sheet with the terminals. The terminals are removed from the carrier strip during a later manufacturing process. In some applications, the terminals are removed from the carrier strip by a machine during another process, such as a crimping process where the crimping machine shears the terminal from the carrier strip as the terminal is being crimped to a wire. The machine has tight tolerances to accurately and repeatably shear the terminal from the carrier strip leaving a small shear tab at the location where the terminal was previously attached to the carrier strip.

In other applications, the terminals are removed from the carrier strip by a handheld tool, such as a terminal cutter. However, conventional handheld terminal cutters lack features to control positioning of the terminal during the cutting process. Handheld terminal cutters produce terminals having shear tabs with variable lengths, and in some circumstances produce terminals having shear tabs that are outside of industry standard lengths.

A need remains for a handheld terminal cutter capable of accurately and consistently positioning terminals in a cutting zone.

BRIEF DESCRIPTION OF THE INVENTION

In one embodiment, a terminal cutter is provided including a tool frame having an upper handle and a lower handle movable relative to each other, a first cutting member coupled to the upper handle and having a first cutting surface for cutting a terminal from a carrier strip carrying a plurality of terminals, and a second cutting member coupled to the lower handle and having a second cutting surface for cutting the terminal from the carrier strip. A terminal strip guide assembly is coupled to at least one of the upper handle and the lower handle offset from the first and second cutting members. The terminal strip guide assembly includes a strip guide having a slot receiving the carrier strip and having a guide surface adjacent the slot. The guide surface is configured to engage the terminal to locate the terminal relative to the terminal strip guide assembly and to control a depth of the carrier strip received in the slot.

In another embodiment, a terminal cutter is provided including a tool frame having an upper handle and a lower handle movable relative to each other, a first cutting member coupled to the upper handle and having a first cutting surface for cutting a terminal from a carrier strip carrying a plurality of terminals, and a second cutting member coupled to the lower handle and having a second cutting surface for cutting the terminal from the carrier strip. A terminal strip guide assembly is coupled to at least one of the upper handle and the lower handle offset from the first and second cutting members. The terminal strip guide assembly includes a strip guide having a slot receiving the carrier strip and a guide blade coupled to the strip guide. The strip guide has a rear guide surface and the guide blade has a front guide surface with a gap defined between the rear guide surface and the front guide surface. The terminal strip guide assembly is configured to receive insulation barrel tabs of the terminals between the rear guide surface and the front guide surface to locate the terminal relative the terminal strip guide assembly.

In a further embodiment, a terminal cutter is provided including a tool frame having an upper handle and a lower handle movable relative to each other, a first cutting member coupled to the upper handle and having a first cutting surface for cutting a terminal from a carrier strip carrying a plurality of terminals, and a second cutting member coupled to the lower handle and having a second cutting surface for cutting the terminal from the carrier strip. A terminal strip guide assembly is coupled to at least one of the upper handle and the lower handle offset from the first and second cutting members. The terminal strip guide assembly includes a strip guide, an adjustment plate coupled to the strip guide, and a guide blade coupled to the adjustment plate. The strip guide has a slot receiving the carrier strip. The strip guide has a rear guide surface and the guide blade having a front guide surface with a gap defined between the rear guide surface and the front guide surface configured to receive a portion of the terminal. The adjustment plate adjusts a position of the guide blade relative to the strip guide to adjust a width of the gap between the rear guide surface and the front guide surface.

DETAILED DESCRIPTION OF THE INVENTION

Figure 1:
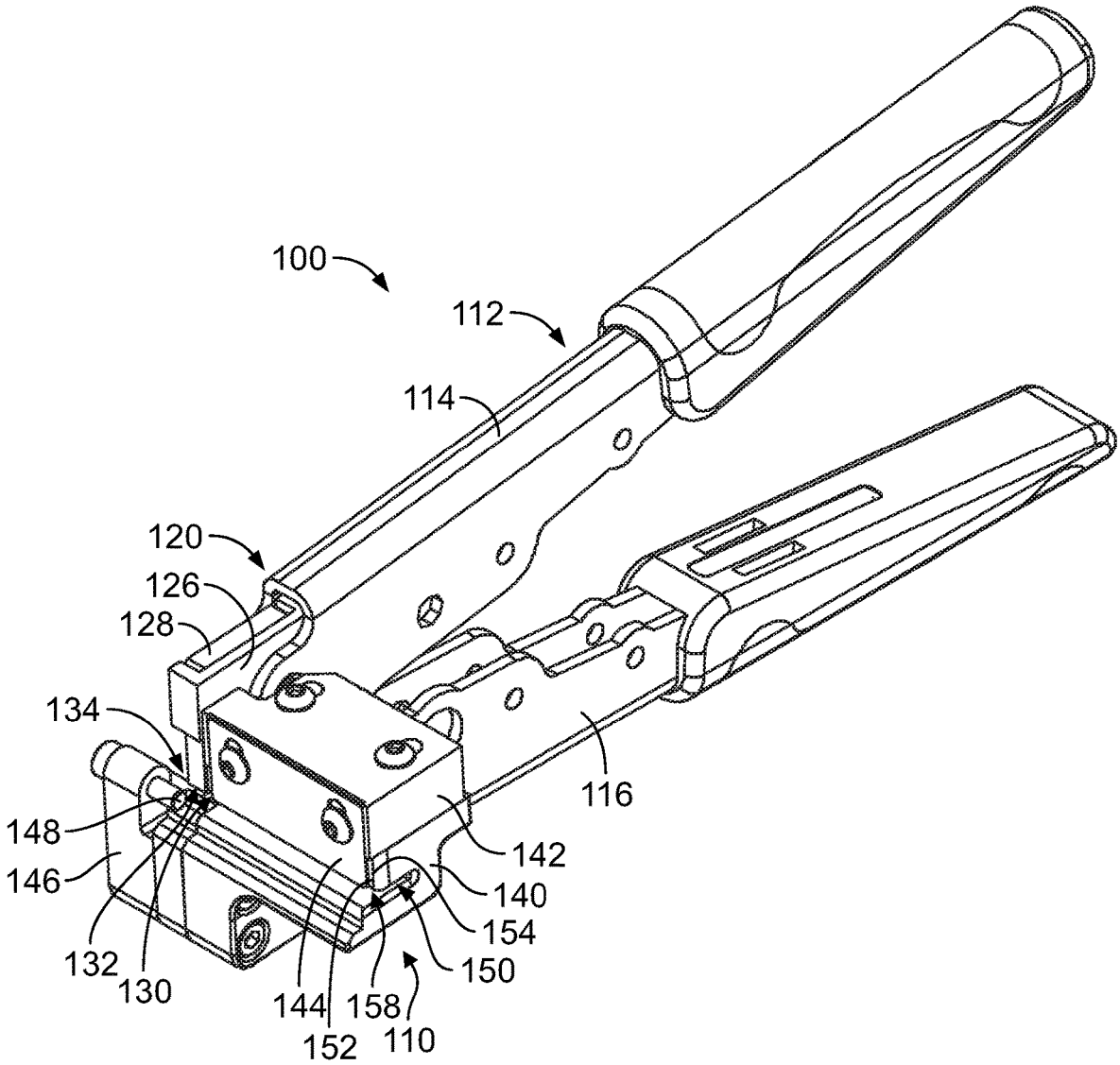
FIG. 1 is a perspective view of a terminal cutter in accordance with an exemplary embodiment used for removing terminals from a carrier strip.
Figure 2:
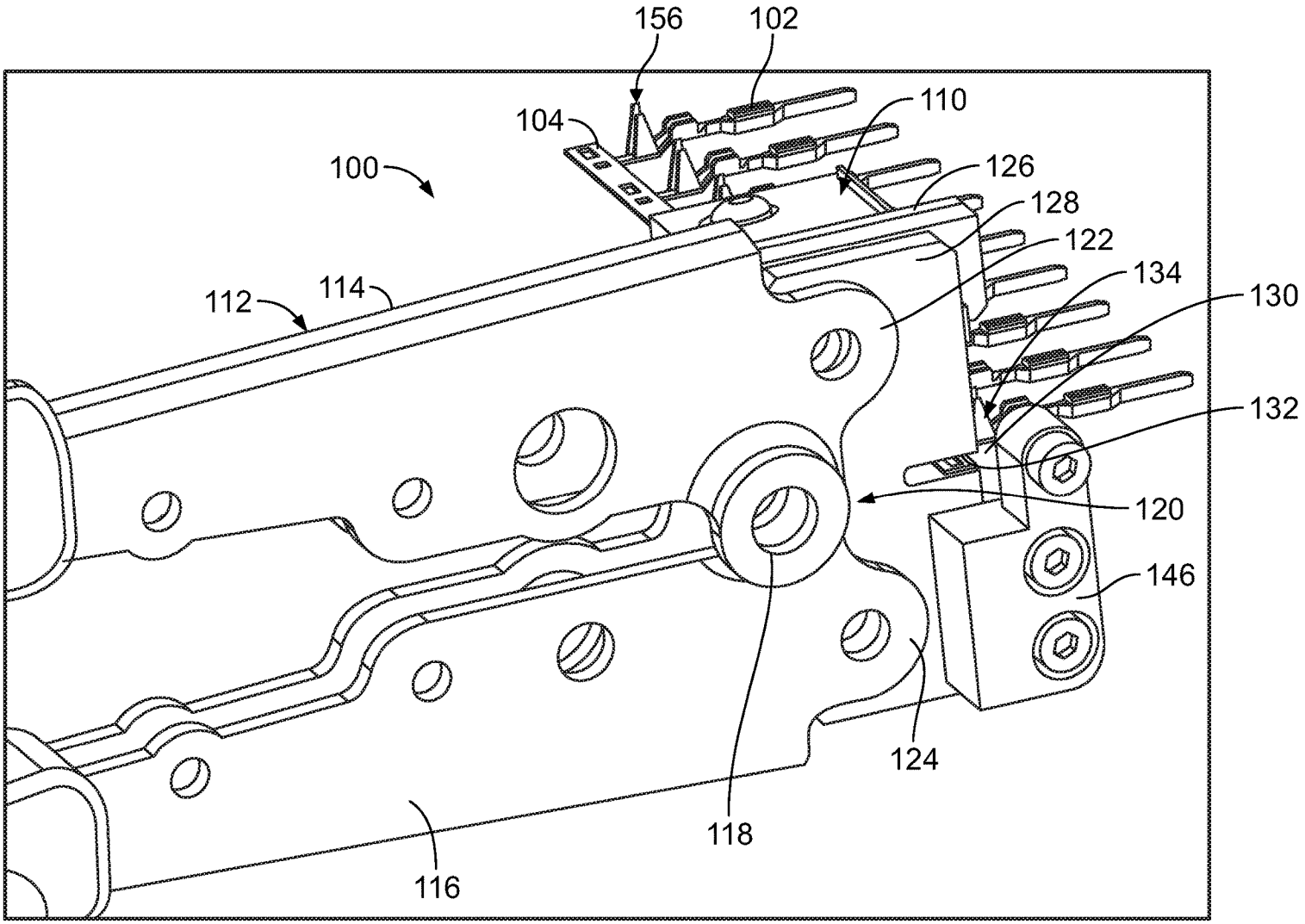
FIG. 2 is a perspective view of a portion of the terminal cutter showing a terminal strip guide assembly.

FIG. 1 is a perspective view of a terminal cutter 100 in accordance with an exemplary embodiment. FIG. 2 is a perspective view of a portion of the terminal cutter 100 used for removing terminals 102 from the carrier strip 104. The terminal cutter 100 is a hand tool that is hand actuated to cut individual terminals 102 from the carrier strip 104. In an exemplary embodiment, the terminal cutter 100 includes a terminal strip guide assembly 110 used to locate the terminals 102 and the carrier strip 104 within the terminal cutter 100 for the cutting process. The terminal strip guide assembly 110 repeatably and accurately positions the terminal 102 and the carrier strip 104 to singulate the terminal 102 from the carrier strip 104 in such a way that a minimally acceptable shear tab remains. For example, the terminal strip guide assembly 110 may position the terminal 102 to ensure that the shear tab is less than 10 mils, less than 5 mils, approximately 1 mil, or another industry acceptable length.

The terminal cutter 100 includes a tool frame 112 having an upper handle 114 and a lower handle 116 movable relative to each other. The upper handle 114 may be pivotably coupled to the lower handle 116 at a pin 118. A biasing mechanism (not shown), such as a spring, may be positioned between the upper handle 114 and the lower handle 116 to bias the upper handle 114 away from the lower handle 116. The upper handle 114 and/or the lower handle 116 may include hand grips for the user. The terminal strip guide assembly 110 is coupled to the upper handle 114 and/or the lower handle 116, such as adjacent to the shearing portions of the terminal cutter 100.

The tool frame 112 includes a head end 120 used for cutting the terminal 102 from the carrier strip 104. The tool frame 112 includes an upper bracket 122 on the upper handle 114 at the head end 120. The tool frame 112 includes a lower bracket 124 on the lower handle 116 at the head end 120. A first cutting member 126 is coupled to the upper handle 114 at the upper bracket 122 and is movable with the upper handle 114. A second cutting member 128 is coupled to the lower handle 116 at the lower bracket 124 and is movable with the lower handle 116. In an exemplary embodiment, the first cutting member 126 moves relative to the second cutting member 128 in a shearing action to shear the terminal 102 from the carrier strip 104. For example, the first cutting member 126 includes a first cutting surface 130 configured to be positioned below the carrier strip 104 and/or the terminal 102 and the second cutting member 128 includes a second cutting surface 132 configured to be positioned above the carrier strip 104 and/or the terminal 102. A cutting zone 134 is defined between the first and second cutting surfaces 130, 132. In an exemplary embodiment, the terminals 102 are individually and successively presented to the cutting zone 134 for removal from the carrier strip 104, such as by a shearing action.

The terminal strip guide assembly 110 includes a strip guide 140, an adjustment plate 142 coupled to the strip guide 140 and a guide blade 144 coupled to the adjustment plate 142. In an exemplary embodiment, the adjustment plate 142 is variably positionable relative to the strip guide 140 and may be mounted at various positions relative to the strip guide 140 to adjust the front-to-back, or lateral, position of the guide blade 144 relative to the strip guide 140. In an exemplary embodiment, the guide blade 144 is variably positionable relative to the adjustment plate 142 and may be mounted at various positions relative to the adjustment plate 142 to adjust a vertical position of the guide blade 144 relative to the strip guide 140.

The terminal strip guide assembly 110 is coupled to the upper handle 114 and/or the lower handle 116 offset from the first and second cutting members 126, 128. In various embodiments, the terminal strip guide assembly 110 includes a terminal stop 146 coupled to the strip guide 140 and/or the cutting members 126, 128 and/or the tool frame 112. The terminal stop 146 is used to position the terminal 102 in the cutting zone 134. For example, the terminal stop 146 may stop loading of the terminals 102 such that the terminal 102 is aligned with the cutting members 126, 128 in the cutting zone 134. Optionally, the terminal stop 146 may be adjustable to adjust the position of a stop surface 148 of the terminal stop 146 to adjust the stopping position of the terminals 102 in the cutting zone 134.

The strip guide 140 includes a slot 150 that receives the carrier strip 104. The strip guide 140 includes a guide surface 152 configured to engage the terminal 102 to locate the terminal 102 relative to the terminal strip guide assembly 110. The guide blade 144 includes a guide surface 154 configured to engage the terminal 102 to locate the terminal 102 relative to the terminal strip guide assembly 110. In the illustrated embodiment, the guide surface 152 is located rearward of a locating portion 156 of the terminal 102 and may be referred to hereinafter as a rear guide surface 152. In the illustrated embodiment, the guide surface 154 is located forward of the locating portion 156 of the terminal 102 and may be referred to hereinafter as a front guide surface 154. In an exemplary embodiment, the position of the guide blade 144 relative to the strip guide 140 is adjustable and controlled by the adjustment plate 142. For example, the front guide surface 154 may be moved closer to or further from the rear guide surface 152 by adjusting the mounting location of the adjustment plate 142 relative to the strip guide 140.

A gap 158 is defined between the rear guide surface 152 and the front guide surface 154. The gap 158 receives the locating portion 156 of the terminal 102. The rear guide surface 152 of the strip guide 140 and the front guide surface 154 of the guide blade 144 confine lateral movement of the locating portion 156 of the terminal 102 in a direction parallel to a terminal axis of the terminal 102. As such, the guide surfaces 152, 154 control a front-to-rear, or lateral, position of the terminal 102, and thus the carrier strip 104, relative to the terminal strip guide assembly 110. By controlling the positions of the locating portions 156 of the terminals 102 passing through the terminal strip guide assembly 110, the terminal strip guide assembly 110 is able to control the reception depth of the carrier strip 104 in the slot 150. The terminal strip guide assembly 110 is thus able to accurately position the carrier strip 104 and the terminal 102 in the cutting zone 134 between the first and second cutting members 126, 128.

Figure 3:
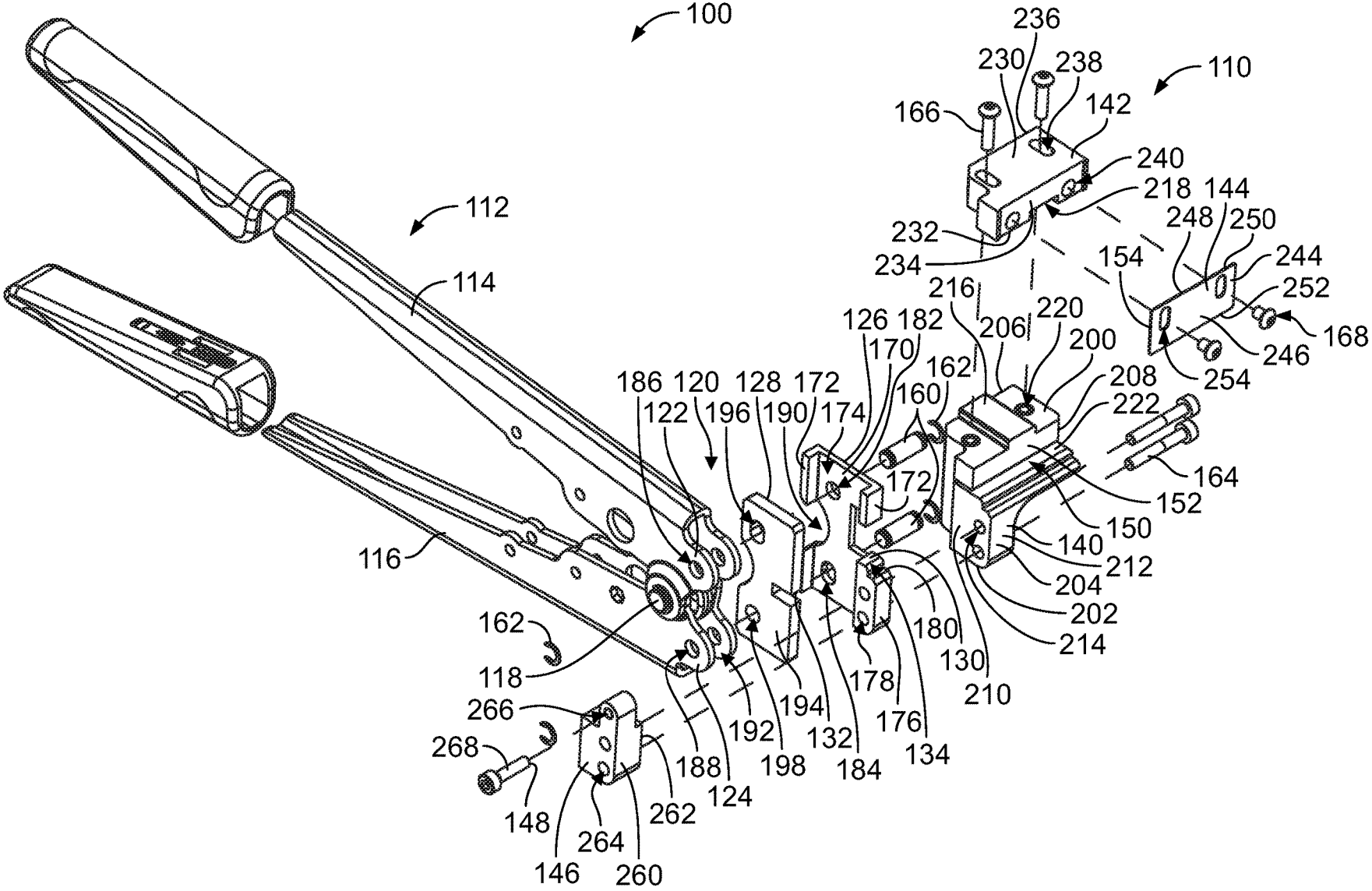
FIG. 3 is an exploded view of the terminal cutter in accordance with an exemplary embodiment.

FIG. 3 is an exploded view of the terminal cutter 100 in accordance with an exemplary embodiment. FIG. 3 shows the upper handle 114 coupled to the lower handle 116 at the pin 118. In an exemplary embodiment, the first and second cutting members 126, 128 are configured to be coupled to the upper and lower brackets 122, 124 using pins 160 and clips 162; however, other coupling devices may be used in alternative embodiments. In an exemplary embodiment, the strip guide 140 is configured to be coupled to the first cutting member 126 using fasteners 164; however, other coupling devices may be used in alternative embodiments. The fasteners 164 are used to secure the terminal stop 146 to the first cutting member 126; however, other coupling devices may be used in alternative embodiments. In other various embodiments, the strip guide 140 may be coupled to a component other than the first cutting member 126, such as the second cutting member 128, the upper bracket 122, the lower bracket 124, or another component. In an exemplary embodiment, the adjustment plate 142 is coupled to the strip guide 140 using fasteners 166; however, other coupling devices may be used in alternative embodiments. In an exemplary embodiment, the guide blade 144 is coupled to the adjustment plate 142 using fasteners 168; however, other coupling devices may be used in alternative embodiments.

The first cutting member 126 includes a main body 170 having flanges 172 defining a pocket 174. The pocket 174 receives the second cutting member 128. In an exemplary embodiment, the first cutting member 126 includes a mounting bracket 176 having openings 178 for receiving the fasteners 164 to secure the strip guide 140 and/or the terminal stop 146 to the mounting bracket 176. The first cutting member 126 includes a platform 180 at a front of the first cutting member 126 for supporting the terminal 102 and/or the carrier strip 104. The platform 180 generally faces upward and defines the cutting zone 134. The first cutting surface 130 is provided at the platform 180.

In an exemplary embodiment, the first cutting member 126 includes openings 182, 184 in the main body 170. The openings 182, 184 receive the pins 160 for securing the first cutting member 126 to the second cutting member 128 and the head end 120 of the tool frame 112. In an exemplary embodiment, the upper and lower brackets 122, 124 include corresponding openings 186, 188, respectively, configured to be aligned with the openings 182, 184 for receiving the pins 160. In the illustrated embodiment, the first opening 182 is circular and the second opening 184 is elongated. The elongated opening 184 allows the corresponding pin 160 to move up and down within the opening 184 when the upper handle 114 and the lower handle 116 are squeezed and released. The pin 160 received in the first opening 182 causes the first cutting member 126 to move upward when the upper handle 114 is closed toward the lower handle 116.

In an exemplary embodiment, the first cutting member 126 includes a cutout 190 at a rear of the main body 170 configured to receive a portion of the tool frame 112, such as the pin 118 and/or the biasing mechanism. The first cutting member 126 is configured to be received in a space 192 defined in the upper and lower brackets 122, 124.

The second cutting member 128 includes a main body 194 configured to be received in the pocket 174. The second cutting member 128 includes openings 196, 198 in the main body 194. The openings 196, 198 receive the pins 160 for securing the second cutting member 128 to the first cutting member 126 and the head end 120 of the tool frame 112. In the illustrated embodiment, the first opening 196 is elongated and the second opening 198 is circular. The elongated opening 196 allows the corresponding pin to move up and down within the opening 196 when the upper handle 114 and the lower handle 116 are squeezed and released. The pin 160 received in the second opening 198 causes the second cutting member 128 to move downward when the lower handle 116 is closed toward the upper handle 114.

Figure 4:
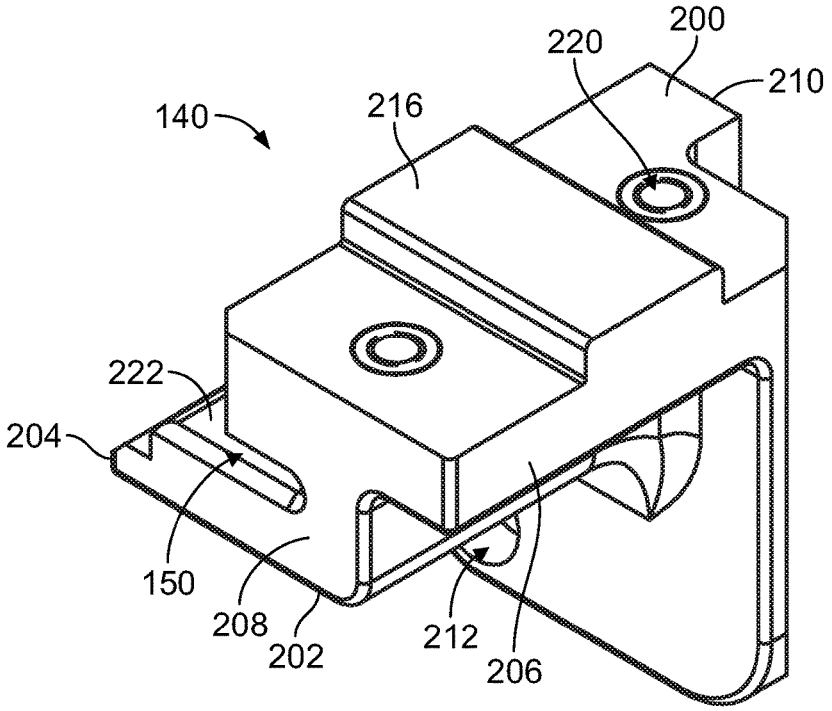
FIG. 4 is a rear perspective view of a strip guide of the terminal strip guide assembly.

With additional reference to FIG. 4, which is a rear perspective view of the strip guide 140, the strip guide 140 includes a top 200, a bottom 202, a front 204, a rear 206, a first side 208 and a second side 210. The slot 150 extends longitudinally between the first and second sides 208, 210. The carrier strip 104 is configured to be fed into the slot 150 through the first side 208. The strip guide 140 includes a mounting bracket 212 at the second side 210 configured to be mounted to the mounting bracket 176 of the first cutting member 126. The mounting bracket 212 includes openings 214 that receive the fasteners 164.

The adjustment plate 142 is configured to be mounted to the top 200 of the strip guide 140. In an exemplary embodiment, the strip guide 140 includes a lug 216 at the top 200 extending laterally between the front 204 and the rear 206. The lug 216 is configured to be received in a channel 218 in the bottom of the adjustment plate 142. The lug 216 is used to align the adjustment plate 142 on the strip guide 140 and control movement of the adjustment plate 142 to lateral, front-to-back movement. The strip guide 140 includes openings 220 that receive the fasteners 166. The openings 220 may be threaded.

In an exemplary embodiment, the strip guide 140 includes a platform 222 forward of the slot 150 and the guide surface 152. The platform 222 is used to support the carrier strip 104 and/or the terminals 102. The platform 222 may be generally coplanar with the slot 150. Optionally, the platform 222 may be stepped to accommodate the shape of the terminals 102.

With reference back to FIG. 3, the adjustment plate 142 includes a body extending between a top 230, a bottom 232, a front 234 and a rear 236. The guide blade 144 is configured to be coupled to the front 234. The channel 218 extends between the front 234 and the rear 236 along the bottom 232. The adjustment plate 142 includes openings 238 extending between the top 230 and the bottom 232. The openings 238 receive the fasteners 166 used to secure the adjustment plate 142 to the strip guide 140. In an exemplary embodiment, the openings 238 are elongated to allow the adjustment plate 142 to be shifted front-to-back to adjust the position of the guide blade 144 relative to the strip guide 140 to control the width of the gap 158 (shown in FIG. 1). The adjustment plate 142 includes openings 240 that receive the fasteners 168 to secure the guide blade 144 to the adjustment plate 142.

The guide blade 144 includes a plate 244 having a front 246 and a rear 248. The rear 248 defines the rear guide surface 154. The plate 244 extends between a top edge 250 and a bottom edge 252. The bottom edge 252 is configured to face the terminals 102. The plate 244 includes openings 254 that receive the fasteners 168 used to secure the guide blade 144 to the adjustment plate 142. In an exemplary embodiment, the openings 254 are elongated to allow the guide blade 144 to be shifted up-and-down to adjust the position of the guide blade 144 relative to the strip guide 140, such as to press the bottom edge 252 against the terminals 102.

The terminal stop 146 includes a body 260 having a mounting bracket 262 configured to be mounted to the mounting bracket 176 of the first cutting member 126 and/or the mounting bracket 212 of the strip guide 140. The mounting bracket 262 includes openings 264 that receive the fasteners 164 to secure the terminal stop 146 to the first cutting member 126. The terminal stop 146 includes a threaded opening 266 that receives an adjustment screw 268. A distal end of the adjustment screw 268 defines the stop surface 148. The axial position of the adjustment screw 268 relative to the terminal stop 146 is adjustable to adjust the position of the stop surface 148 relative to the cutting zone 134.

Figure 5:
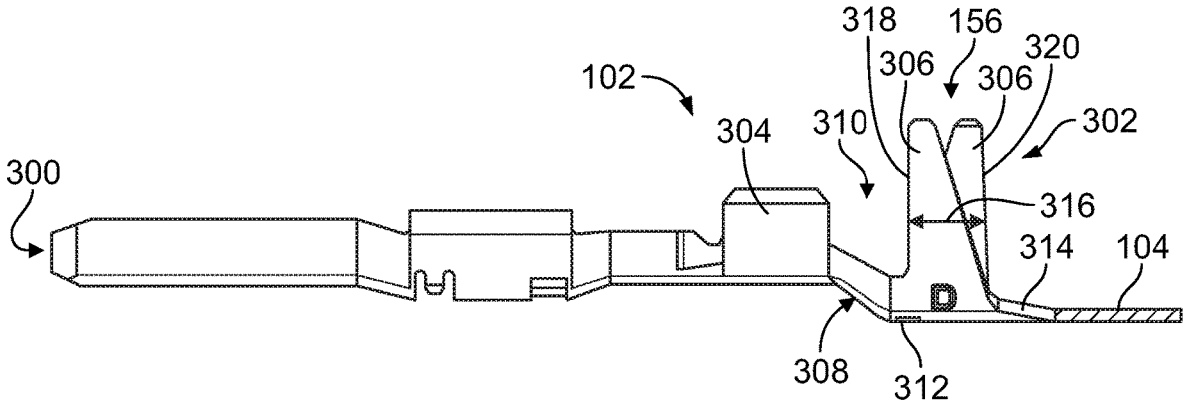
FIG. 5 is a side, partial sectional view of the terminal in accordance with an exemplary embodiment.

FIG. 5 is a side, partial sectional view of an exemplary terminal 102 for use with the terminal cutter 100 in accordance with an exemplary embodiment. The terminal 102 extends between a mating end 300 and a wire end 302. The mating end 300 is configured to be mated with a mating terminal. The mating end 300 may be a male mating end having a pin or a female mating end having a socket in various embodiments. The wire end 302 is configured to be crimped to a wire (not shown) in various embodiments. The wire end 302 includes wire barrel tabs 304 configured to be terminated to the conductor of the wire and insulation barrel tabs 306 configured to be terminated to the insulator of the wire. For example, the wire barrel tabs 304 may be crimped to the conductor and the insulation barrel tabs 306 may be crimped to the insulator.

The terminal 102 includes a transition area 308 between the wire barrel tabs 304 and the insulation barrel tabs 306. A space 310 is provided between the wire barrel tabs 304 and the insulation barrel tabs 306. In an exemplary embodiment, because the insulator has a greater diameter than the conductor of the wire, a bottom 312 of the terminal 102 is vertically stepped in the transition area 308 between the wire barrel tabs 304 and the insulation barrel tabs 306. Different types of terminals 102 may be stepped different vertical heights in the transition area 308. The carrier strip 104 and a carrier tab 314 between the carrier strip 104 and the terminal 102 is generally coplanar with the bottom 312 at the insulation barrel tabs 306. The carrier tab 314 is the portion of the carrier strip 104 that is cut to remove the terminal 102 from the carrier strip 104. A shear tab is the remaining portion of the carrier tab 314 that is not removed from the terminal 102 after being cut. In an exemplary embodiment, the length of the shear tab is minimized to a minimally acceptable length, such as less than 10 mils, less than 5 mils, approximately 1 mil, or another industry acceptable length.

In an exemplary embodiment, the insulation barrel tabs 306 have a width 316 defined between a front edge 318 and a rear edge 320 of the insulation barrel tabs 306. Optionally, the front edge 318 may be provided on one of the insulation barrel tabs 306 and the rear edge 320 may be provided on the other insulation barrel tab 306. Different types of terminals 102 may have different widths 316 of the insulation barrel tabs 306. In an exemplary embodiment, the insulation barrel tabs 306 define the locating portion 156 of the terminal 102 configured to be received in the gap 158 (shown in FIG. 1) of the terminal strip guide assembly 110 (shown in FIG. 1).

Figure 6:
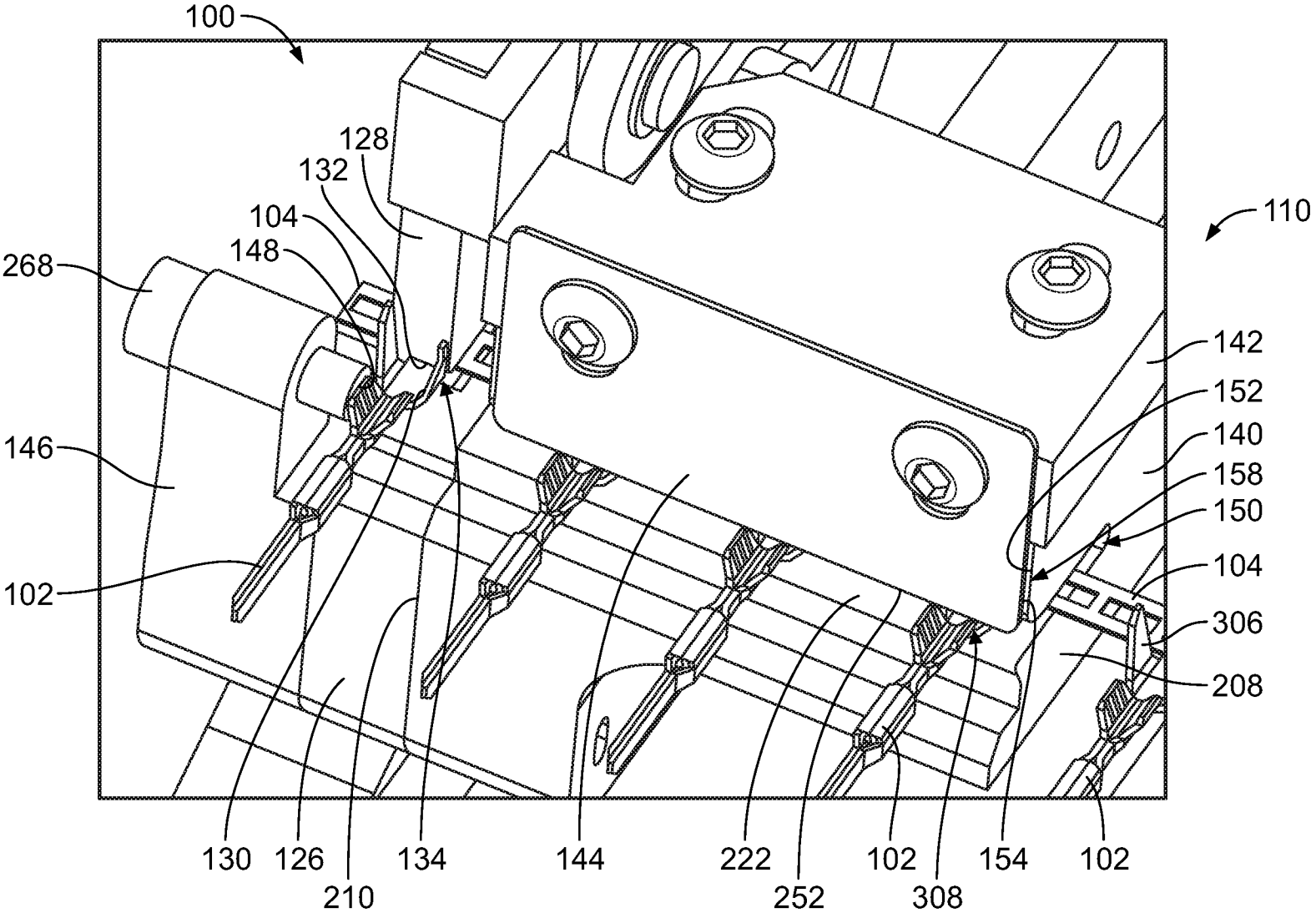
FIG. 6 is a front perspective view of a portion of the terminal cutter showing the carrier strip and the terminals loaded in the terminal cutter.
Figure 7:
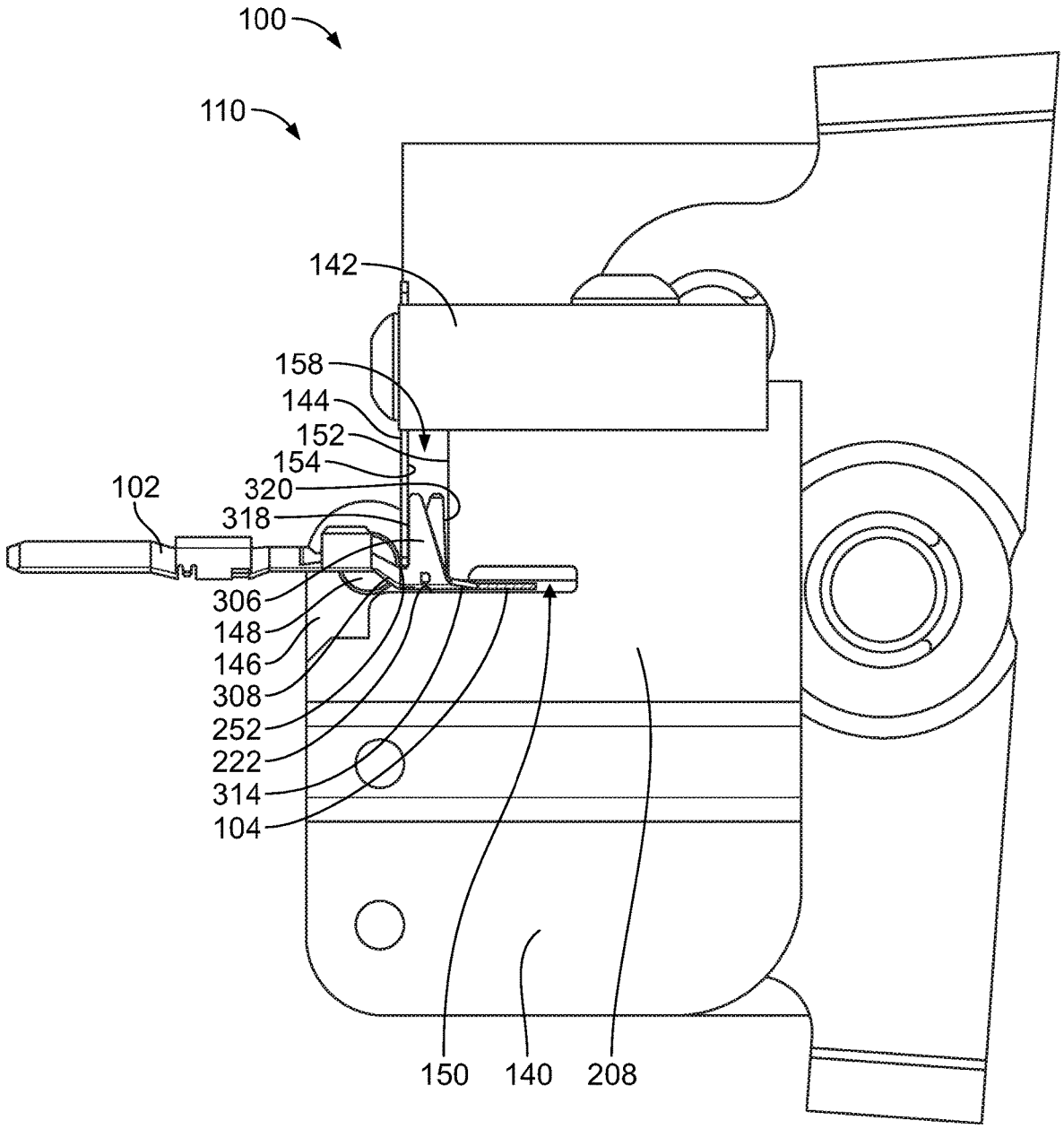
FIG. 7 is a side view of a portion of the terminal cutter showing the carrier strip and the terminal loaded in the terminal cutter.

FIG. 6 is a front perspective view of a portion of the terminal cutter 100 showing the carrier strip 104 and the terminals 102 loaded in the terminal cutter 100. FIG. 7 is a side view of a portion of the terminal cutter 100 showing the carrier strip 104 and the terminal 102 loaded in the terminal cutter 100. The carrier strip 104 and the terminals 102 are loaded into the terminal strip guide assembly 110 and the terminal strip guide assembly 110 guides the terminals 102 to the cutting members 126, 128. The carrier strip 104 is loaded into the slot 150 through the first side 208 of the strip guide 140. The terminals 102 extend forward of the strip guide 140 while the carrier strip 104 is positioned in the slot 150.

In an exemplary embodiment, the strip guide 140 and the guide blade 144 locate the terminals 102, which locates the carrier strip 104 and controls the depth of the carrier strip 104 in the slot 150. The terminals 102 are positioned such that the insulation barrel tabs 306 are received in the gap 158 between the rear guide surface 152 of the strip guide 140 and the front guide surface 154 of the guide blade 144. For example, the rear edge 320 of the insulation barrel tabs 306 engages the rear guide surface 152 and the front edge 318 of the insulation barrel tabs 306 engages the front guide surface 154. The strip guide 140 and the guide blade 144 confined lateral movements of the terminals 102 by controlling the width of the gap 158 to ensure accurate and consistent positioning of the terminals 102. In an exemplary embodiment, the guide blade 144 is positioned relative to the strip guide 140 such that the gap 158 is equal to the width 316 or only slightly larger than the width 316 such that the insulation barrel tabs 306 do not bind against the strip guide 140 or the guide blade 144 as the terminals 102 pass through the terminal strip guide assembly 110.

The adjustment plate 142 is adjustable relative to the strip guide 140 to control the lateral position of the guide blade 144, and thus the width of the gap 158. For example, the adjustment plate 142 may be moved forward or rearward relative to the strip guide 140 to change the width of the gap 158, such as to accommodate different types of terminals having insulation barrel tabs 306 having different widths 316. During use, the insulation barrel tabs 306 are pushed rearward against the rear guide surface 152 of the strip guide 140. The guide blade 144 stops the terminals 102 from shifting forward.

In an exemplary embodiment, the bottom edge 252 of the guide blade 144 is positioned directly vertically above the terminal 102 in the transition area 308. Optionally, the bottom edge 252 may be seated against the transition area 308 to hold the terminal 102 downward against the platform 222. The terminal strip guide assembly 110 is configured to capture the transition area 308 of the terminal 102 between the platform 222 and the bottom edge 252 of the guide blade 144. In an exemplary embodiment, the guide blade 144 is adjustable up and down relative to the adjustment plate 142 to control the position of the bottom edge 252, such as to accommodate different types of terminals having different shaped to transition areas 308.

During cutting with the terminal cutter 100, the carrier strip 104 and the terminals 102 are moved sideways to position one of the terminals 102 in the cutting zone 134 (FIG. 6). In an exemplary embodiment, the terminal 102 being separated from the carrier strip 104 is moved out of the terminal strip guide assembly 110 beyond the first side 208 of the strip guide 140 to align with the cutting members 126, 128. For example, the rear guide surface 152 and the front guide surface 154 are axially offset with respect to the first and second cutting surfaces 130, 132 (for example, shifted to one side of the cutting surfaces 130, 132) such that the terminal 102 aligned with the first and second cutting members 126, 128 is axially offset from the strip guide 140 and the guide blade 144. The carrier tab 314 of such terminal 102 is positioned in the cutting zone 134 between the first and second cutting surfaces 130, 132. The terminal stop 146 is used to locate the terminal 102 relative to the cutting members 126, 128. For example, the carrier strip 104 and the terminal 102 are moved sideways until the terminal 102 abuts against the stop surface 148 of the terminal stop 146.

The cutting members 126, 128 operate outside of the terminal strip guide assembly 110 and the terminal strip guide assembly 110 does not need to accommodate portions of the cutting members 126, 128 therein. Thus, the terminal strip guide assembly 110 may be made smaller and lighter than if the cutting members 126, 128 were housed inside the terminal strip guide assembly 110. While the terminal 102 being separated from the carrier strip 104 is no longer positioned in the terminal strip guide assembly 110, the position of such terminal 102 is still controlled by the terminal strip guide assembly 110, which guides the carrier strip 104 and other terminals 102.

In an exemplary embodiment, the adjustment screw 268 is adjustable to control the position of the stop surface 148 relative to the cutting members 126, 128, such as to accommodate different types of terminals having different shapes. In the illustrated embodiment, the wire barrel tabs 308 about against the stop surface 148 to position the terminal 102 and the cutting zone 134.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A terminal cutter comprising:

a tool frame having an upper handle and a lower handle extending rearward from a front of the tool frame, the upper handle extending along an upper handle axis and the lower handle extending along a lower handle axis, the upper handle and the lower handle being movable relative to each other at a pivot axis, the pivot axis being perpendicular to the upper handle axis and the lower handle axis, the tool frame having a first side and a second side;

a first cutting member coupled to the upper handle and having a first cutting surface defining a cutting edge for cutting a terminal from a carrier strip carrying a plurality of terminals, the first cutting surface being oriented generally perpendicular to the upper handle axis, the first cutting surface being oriented generally parallel to the pivot axis, the first cutting surface extending across the tool frame between the first side and the second side;

a second cutting member coupled to the lower handle and having a second cutting surface defining a cutting edge for cutting the terminal from the carrier strip, the second cutting surface being oriented generally perpendicular to the lower handle axis, the second cutting surface being oriented generally parallel to the pivot axis, the second cutting surface extending across the tool frame between the first side and the second side; and a terminal strip guide assembly coupled to at least one of the upper handle and the lower handle and offset from the first and second cutting members, the terminal strip guide assembly comprising a strip guide having a slot for receiving the carrier strip, the slot extending along an axis oriented parallel to the cutting edges defined by the first cutting surface and the second cutting surface, the axis of the slot is oriented generally parallel to the pivot axis, the strip guide having a guide surface outside of the slot, wherein the guide surface is configured to engage the terminal to locate the terminal relative to the terminal strip guide assembly and to control a depth of the carrier strip received in the slot, the guide surface being generally perpendicular to the lower handle axis and generally parallel to the cutting surfaces defined by the first cutting surface and the second cutting surface.

2. The terminal cutter of claim 1, wherein the guide surface is configured to engage and locate insulation barrel tabs of the terminals to locate the carrier strip in the slot at a predetermined depth within the slot such that the carrier strip does not bottom out in the slot.

3. The terminal cutter of claim 1, wherein the guide surface is axially offset with respect to the first and second cutting surfaces such that the terminal aligned with the first and second cutting members being cut from the carrier strip is axially offset from the strip guide.

4. The terminal cutter of claim 1, wherein the strip guide includes a top, a bottom, a front, a rear, a first side and a second side, the guide surface being provided at the front above the slot, the guide surface extending an entire length of the strip guide between the first side of the strip guide and the second side of the strip guide, the first cutting member and the second cutting member being provided at the second side of the strip guide.

5. The terminal cutter of claim 1, wherein the strip guide includes a platform forward of the slot, the platform configured to support the terminals extending from the carrier strip, the guide surface being located above the platform.

6. The terminal cutter of claim 1, wherein the terminal strip guide assembly includes a guide blade coupled to the strip guide and facing the guide surface such that a gap is defined between the guide blade and the guide surface for receiving a portion of the terminal, the guide blade being configured to engage the terminal to locate the terminal relative to the terminal strip guide assembly to control the depth of the carrier strip received in the slot.

7. The terminal cutter of claim 6, wherein the guide surface and the guide blade are configured to confine lateral movement of the carrier strip and the terminals in a direction parallel to the terminals to control the depth of the carrier strip received in the slot.

8. The terminal cutter of claim 1, wherein the terminal strip guide assembly includes an adjustment plate coupled to the strip guide and a guide blade coupled to the adjustment plate and facing the guide surface across a gap receiving a portion of the terminal, the adjustment plate being adjustable relative to the strip guide to adjust a lateral position of the guide blade with respect to the guide surface to control a width of the gap.

9. The terminal cutter of claim 8, wherein the guide blade is adjustably coupled to the adjustment plate to adjust a vertical position of the guide blade relative to the terminals.

10. The terminal cutter of claim 1, further comprising a terminal stop positioned adjacent the first and second cutting members, the terminal stop having a stop surface configured to engage the terminal being removed from the carrier strip to locate the terminal in alignment with the first and second cutting surfaces.

11. The terminal cutter of claim 1, wherein the terminal strip guide assembly is coupled to at least one of the first cutting member and the second cutting member using fasteners.

12. A terminal cutter comprising:

a tool frame having an upper handle and a lower handle extending rearward from a front of the tool frame, the upper handle extending along an upper handle axis, the lower handle extending along a lower handle axis, the upper handle and the lower handle being movable relative to each other at a pivot axis, the pivot axis being perpendicular to the upper handle axis and the lower handle axis, the tool frame having a first side and a second side;

a first cutting member coupled to the upper handle and having a first cutting surface defining a cutting edge for cutting a terminal from a carrier strip carrying a plurality of terminals, the first cutting surface being oriented generally perpendicular to the upper handle axis, the first cutting surface being oriented generally parallel to the pivot axis, the first cutting surface extending across the tool frame between the first side and the second side;

a second cutting member coupled to the lower handle and having a second cutting surface defining a cutting edge for cutting the terminal from the carrier strip, the second cutting surface being oriented generally perpendicular to the lower handle axis, the second cutting surface being oriented generally parallel to the pivot axis, the second cutting surface extending across the tool frame between the first side and the second side; and a terminal strip guide assembly coupled to at least one of the upper handle and the lower handle, the terminal strip guide assembly comprising a strip guide and a guide blade coupled to the strip guide, the strip guide having a slot for receiving the carrier strip, the slot extending along an axis oriented parallel to the cutting edges defined by the first cutting surface and the second cutting surface, the strip guide including a platform forward of the slot, the platform configured to support the terminals extending from the carrier strip, the strip guide having a rear guide surface located above the platform and the guide blade having a front guide surface located above the platform, a gap being defined between the rear guide surface and the front guide surface, the front guide surface and the rear guide surface extending parallel to the cutting edges defined by the first cutting surface and the second cutting surface, the terminal strip guide assembly is configured to receive insulation barrel tabs of the terminals between the rear guide surface and the front guide surface to locate the terminal relative the terminal strip guide assembly.

13. The terminal cutter of claim 12, wherein the rear guide surface and the front guide surface are axially offset with respect to the first and second cutting surfaces such that the terminal aligned with the first and second cutting members being cut from the carrier strip is axially offset from the strip guide and the guide blade.

14. The terminal cutter of claim 12, wherein the strip guide includes a top, a bottom, a front, a rear, a first side and a second side, the rear guide surface being provided at the front, the first cutting member and the second cutting member being provided at the second side of the strip guide.

15. The terminal cutter of claim 12, the guide blade having a bottom edge above the platform, wherein the terminal strip guide assembly is configured to capture the terminal between the platform and the bottom edge of the guide blade.

16. The terminal cutter of claim 12, wherein the rear guide surface and the front guide surface configured to confine lateral movement of the terminals in a direction parallel to the terminals to control the depth of the carrier strip received in the slot.

17. The terminal cutter of claim 12, wherein the terminal strip guide assembly includes an adjustment plate coupled to the strip guide and supporting the guide blade, the adjustment plate being adjustable relative to the strip guide to adjust a lateral position of the front guide surface of the guide blade with respect to the rear guide surface of the strip guide to control a width of the gap.

18. The terminal cutter of claim 17, wherein the guide blade is adjustably coupled to the adjustment plate to adjust a vertical position of the guide blade relative to the terminals.

19. The terminal cutter of claim 12, further comprising a terminal stop positioned adjacent the first and second cutting members, the terminal stop having a stop surface configured to engage the terminal being removed from the carrier strip to locate the terminal and alignment with the first and second cutting surfaces.

20. A terminal cutter comprising:

a tool frame having an upper handle and a lower handle movable relative to each other;

a first cutting member coupled to the upper handle and having a first cutting surface for cutting a terminal from a carrier strip carrying a plurality of terminals;

a second cutting member coupled to the lower handle and having a second cutting surface for cutting the terminal from the carrier strip; and a terminal strip guide assembly coupled to at least one of the upper handle and the lower handle, the terminal strip guide assembly comprising a strip guide, an adjustment plate coupled to the strip guide, and a guide blade coupled to the adjustment plate, the strip guide having a slot for receiving the carrier strip, the strip guide having a rear guide surface and the guide blade having a front guide surface with a gap defined between the rear guide surface and the front guide surface configured to receive a portion of the terminal, wherein the adjustment plate adjusts a position of the guide blade relative to the strip guide to adjust a width of the gap between the rear guide surface and the front guide surface.

* * * * *